US009470041B2

(12) United States Patent
Ash

(10) Patent No.: US 9,470,041 B2
(45) Date of Patent: Oct. 18, 2016

(54) RAIL AND POST ASSEMBLY AND METHOD OF USE

(76) Inventor: Gary W. Ash, Valley Center, CA (US)

( * ) Notice: Subject to any disclaimer, the term of this patent is extended or adjusted under 35 U.S.C. 154(b) by 425 days.

(21) Appl. No.: 13/407,758

(22) Filed: Feb. 29, 2012

(65) Prior Publication Data

US 2013/0221303 A1 Aug. 29, 2013

(51) Int. Cl.

| | |
|---|---|
| ***E04H 17/00*** | (2006.01) |
| ***E06B 11/02*** | (2006.01) |
| ***E04H 17/14*** | (2006.01) |
| *E04F 11/18* | (2006.01) |

(52) U.S. Cl.

CPC ..... *E06B 11/02* (2013.01); *E04H 17/1413* (2013.01); *E04F 11/181* (2013.01); *E04H 2017/1452* (2013.01); *Y10T 29/49947* (2015.01); *Y10T 29/49954* (2015.01); *Y10T 29/49956* (2015.01); *Y10T 29/49963* (2015.01); *Y10T 29/49968* (2015.01)

(58) Field of Classification Search

CPC ..... E04H 17/1413; E04H 2017/1452; E04H 17/1417; E04H 17/1421; E04H 17/1434; E04H 17/1443; E04H 17/1447; E04H 17/1452; E06B 11/02

USPC ..... 256/59–62, 65.01, 65.02, 65.08, 65.11, 256/65.12, 69, 73; 211/182, 189, 191, 192

See application file for complete search history.

(56) References Cited

U.S. PATENT DOCUMENTS

| | | | | |
|---|---|---|---|---|
| 917,083 | A | 4/1909 | Kyle | |
| 2,611,633 | A | 9/1952 | Webster | |
| 2,852,876 | A | 9/1958 | Blum | |
| 3,071,399 | A * | 1/1963 | Cronin | 403/219 |
| 3,318,183 | A * | 5/1967 | Artur Fischer | 411/80.1 |
| 3,484,827 | A * | 12/1969 | Hall | 256/59 |
| 3,519,292 | A * | 7/1970 | Krikorian | 403/258 |
| 3,960,275 | A * | 6/1976 | Haughton et al. | 211/182 |
| 4,007,919 | A * | 2/1977 | Totten | 256/59 |
| 4,149,701 | A | 4/1979 | Densen | |
| 4,542,885 | A | 9/1985 | Rossiter | |
| 4,714,169 | A | 12/1987 | Keenan et al. | |
| 4,952,092 | A * | 8/1990 | Ballerstein | 403/174 |
| 5,134,806 | A | 8/1992 | Burkart, Jr. | |
| 5,161,783 | A * | 11/1992 | German | 256/19 |
| 6,179,274 | B1 | 1/2001 | Irwin, III | |
| 6,464,209 | B2 * | 10/2002 | Meis et al. | 256/73 |
| 6,874,766 | B2 * | 4/2005 | Curatolo | E04F 11/1817 256/59 |
| 7,000,673 | B2 * | 2/2006 | Cook | 160/210 |
| 7,134,647 | B2 * | 11/2006 | Graber | E04H 17/1443 256/22 |
| 7,186,050 | B2 * | 3/2007 | Dean et al. | 403/344 |
| 7,322,564 | B2 | 1/2008 | Fakhari | |
| 7,448,820 | B1 * | 11/2008 | Faber | 403/240 |
| 7,500,655 | B1 * | 3/2009 | Smith et al. | 256/67 |
| 7,503,275 | B2 * | 3/2009 | Daniels et al. | 114/361 |
| 7,540,472 | B2 * | 6/2009 | Striebel et al. | 256/67 |
| 7,543,369 | B2 | 6/2009 | Burkett | |
| 2002/0066898 | A1 | 6/2002 | Meis et al. | |
| 2005/0127346 | A1 | 6/2005 | Steffes | |
| 2005/0211969 | A1 * | 9/2005 | Graber | 256/65.08 |

(Continued)

*Primary Examiner* — Gregory Binda
*Assistant Examiner* — Nahid Amiri
(74) *Attorney, Agent, or Firm* — Todd J. Langford; Eric A. Hanscom

(57) ABSTRACT

A rail and post assembly that allows for onsite fence and gate panel construction. A shear block is affixed to each end of a rail. The shear block and rail are then fed through an opening in a post. Fasteners then secure the shear block to the post, which thereby provides a rail and post assembly.

18 Claims, 3 Drawing Sheets

(56) References Cited

U.S. PATENT DOCUMENTS

| | | | |
|---|---|---|---|
| 2005/0269558 | A1 | 12/2005 | Keefe |
| 2007/0221903 | A1 | 9/2007 | Robbins |
| 2008/0179581 | A1 | 7/2008 | Mulgrew |
| 2010/0252793 | A1 | 10/2010 | Ash |
| 2011/0147688 | A1 | 6/2011 | Esposito |

* cited by examiner

RAIL AND POST ASSEMBLY AND METHOD OF USE

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of fences and gates, and more specifically toward a rail and post assembly that allows for onsite fence and gate panel construction. A shear block is affixed to each end of a rail. The shear block and rail are then fed through an opening in a post. Fasteners then secure the shear block to the post, which thereby provides a rail and post assembly.

Fences have been around for thousands of years. From delineating ownership of land to corralling animals, fences play an important role in everyday life. Because of the large demand for fences, there is a great need for versatile fencing materials that produce aesthetically pleasing fences. Construction of the fence should occur quickly and at minimal cost.

To this end, the prior art teaches fences made of extrudable material, such as aluminum or plastic. The materials are cheap and the parts of the fence can be manufactured with little cost. In one embodiment, a fence is created using posts, two or more rails, and a plurality of pickets. The posts are vertically secured to the ground, and the rails are horizontally secured between the posts. The pickets are then vertically secured to the one or more rails. A gate, or a hinged barrier used to close an opening in a fence, has a similar construction to that of a panel of a fence; however, the gate must have a more rigid construction such that it will maintain its shape when supported only by hinges on one of its posts.

To provide sufficient rigidity of a gate and/or fence panel, these panels are often welded together, especially where the rail meets the post. Due to the complexities of welding as well as the tools and material required to weld, gate and fence panels are often welded together at a central manufacturing location, and then shipped to the construction site where they are installed.

However, shipping each panel, and especially multiple panels, is relatively expensive and time consuming. Even if the weight of each panel is not relatively significant, the size and shape often is. The components of a six-foot by four-foot gate may weigh less than thirty pounds, but the oversized dimensions of the prefabricated, welded panel often necessitate extra shipping charges by common carrier. These shipping charges may be three times or more compared to shipping the panel in pieces and assembling it together on site. As stated above, welding onsite is often impracticable, as it requires experienced personnel with specialized tools that in many cases are not readily available, and even if they are available, are usually expensive. In many instances that panel cannot even be welding onsite since the welding can violate the powder coat, which would then require the entire gate to be re-coated.

Further inefficiencies arise when only a single panel of a fence or gate needs to be installed at a location. Generally, when building an entire new fence for a specific location, materials can be constructed and shipped in bulk, which reduces the overall cost of the project. However, when a single panel is to be installed, such as when a previously constructed fence incurs damage to one of its panels or gates, the cost to replace that single panel may be significant, in large part due to the cost of shipping by common carrier.

The prior art teaches a rail and picket assembly that does not require welding. U.S. Pat. Pub. No. 20100252793 to Ash teaches a fence rail that includes a detachable fastener cover that covers and conceals a fastener chamber. Through the use of a knuckle and a catch fastening system, moisture is prevented from entering the fastener chamber. The fastener chamber allows for securing pickets to the rail using a means for fastening as close to the top of the rail as possible thereby allowing for significant racking of the fence. However, this patent publication does not teach or disclose a way to secure the rails to a post without welding.

Thus there has existed a long-felt need for a system and method for constructing a rigid panel onsite without the use of welding, where the panel is strong enough to act as a gate but can be shipped using a small package carrier without unreasonably high fees. The need continues for such a panel that is easily and quickly assembled onsite, whereby individuals without specialized experience may assemble the panel in a timely manner.

SUMMARY OF THE INVENTION

The current invention provides just such a solution by having a rail and post assembly that allows for onsite fence and gate panel construction. A shear block is affixed to each end of a rail. The shear block and rail are then fed through a pass through opening in a post. Fasteners then secure the shear block to the back of the post, which thereby provides a rail and post assembly.

It is a principal object of the invention to provide a rail and post assembly that may be assembled without welding at a remote location.

It is another object of the invention to provide a rail and post assembly that can be assembled onsite.

It is a further object of the invention to provide a rail and post assembly that can be shipped by a small package carrier.

It is an additional object of the invention to provide a method for assembling a panel without welding.

It is yet another object of the invention to provide a method for assembling a gate panel without welding.

It is a further object of the invention to provide a method for assembling a fence panel without welding.

It is an additional object of the invention to provide a gate panel that can be shipped by a small package carrier and quickly and easily constructed onsite.

It is another object of the invention to provide a fence panel that can be shipped by common carrier and quickly and easily constructed onsite.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
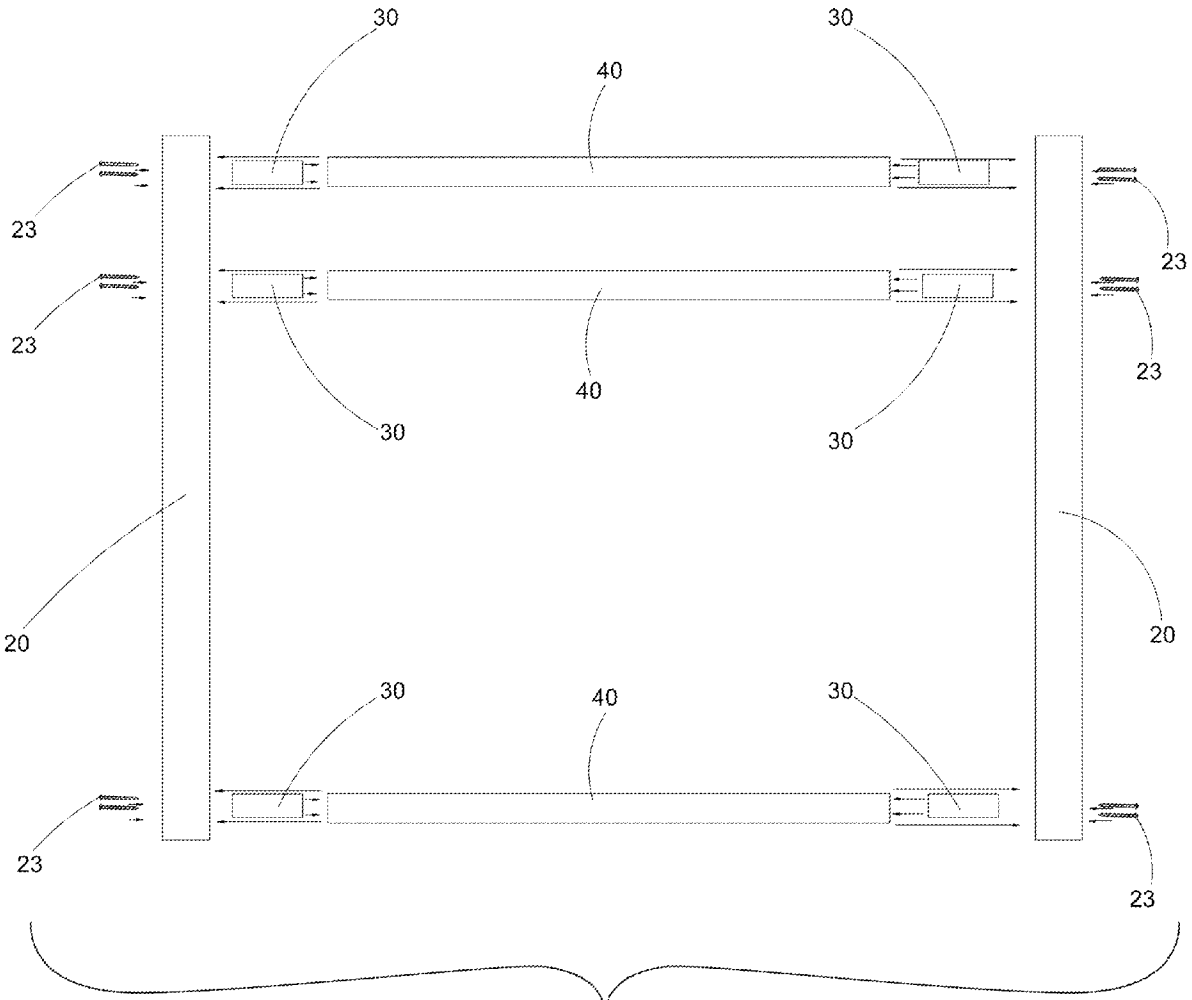
FIG. 1 is an exploded view of a fence panel according to selected embodiments of the current disclosure.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is an exploded view of a fence panel according to selected embodiments of the current disclosure. Shear blocks 30 slide into each end of rails 40. The rails 40 with the shear blocks 30 secured therein are then secured to posts 20 by means of fasteners 23.

Figure 2:
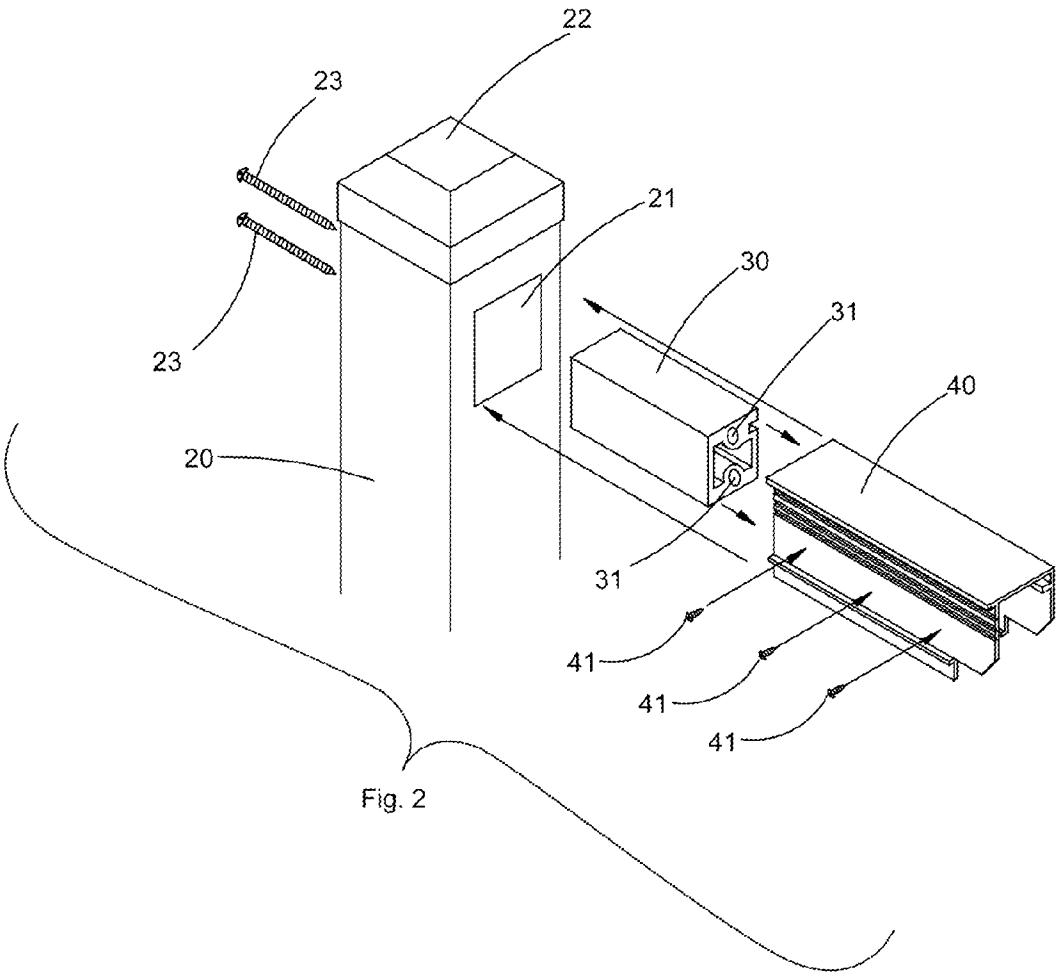
FIG. 2 is a close-up exploded view of a fence and rail assembly according to selected embodiments of the current disclosure.

FIG. 2 is a close-up exploded view of a fence and rail assembly according to selected embodiments of the current disclosure. The main components of the rail and post assembly include a post 20, a rail 40, and a shear block 30. The shear block 30 mates with an end of a rail 40 and can be secured thereto. Each shear block 30 preferably has openings 31 that mate with fasteners 23, discussed in more detail below. These openings may be located on one side or both sides of the shear block 30; however, by placing the openings on both sides of the shear block 30, the same shear block 30 may be secured to either end of the rail 40.

In a particular embodiment, fasteners 41 such as screws are used to secure the rail 40 and shear block 30 together. The post 20 includes an opening 20 that approximately matches the size and shape of the rail 40, such that the rail 40 may be positioned therethrough with minimal spacing between the rail 40 and the edge of the opening 21. Fasteners 23 are used to secure the shear block 30 to the post 20, where the fasteners 23 travel through the post 20 on the opposite side from the opening 21 and into the shear block 30. In this manner, the rail 40 can be appropriately secured to the post 20 without welding the two parts together. In this view, a cap 22 is placed on top of the post 20.

Figure 3:
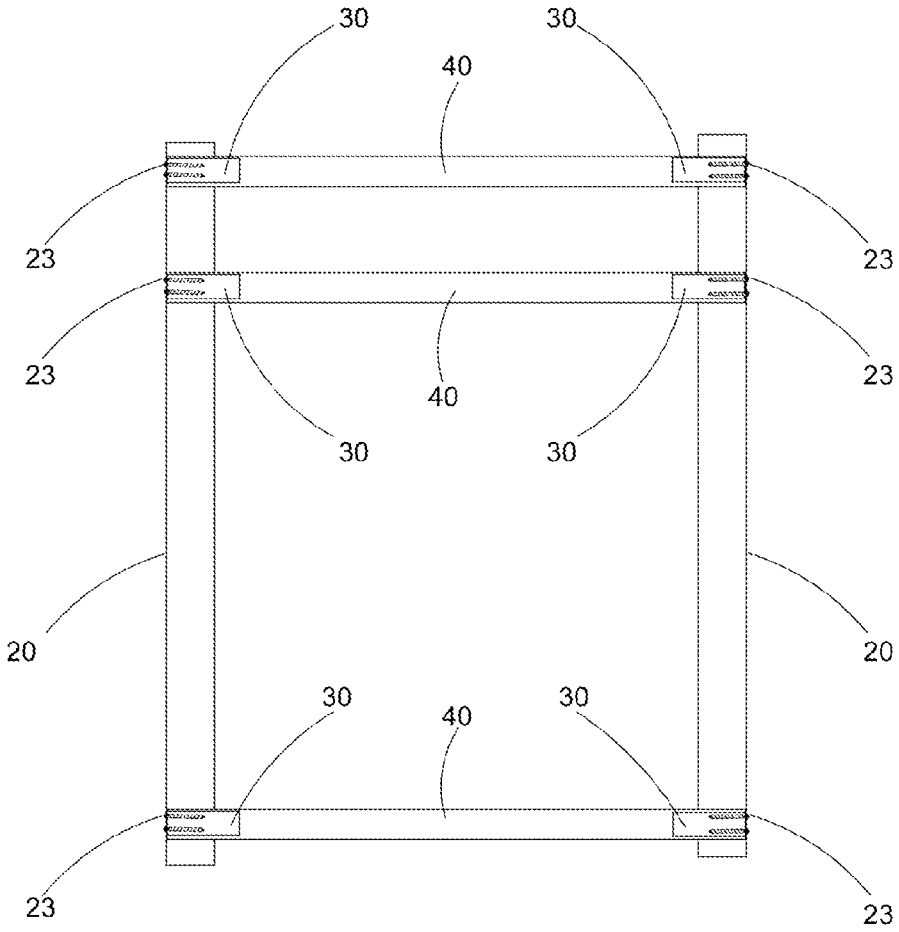
FIG. 3 is a side view of an assembled fence panel according to selected embodiments of the current disclosure.

FIG. 3 is a side view of an assembled fence panel according to selected embodiments of the current disclosure. Each rail 40 includes two shear blocks 30, one located at each end. The shear blocks 30 are secured to the rails 40 as well as to a post 20 by means of fasteners 23. As shown in this figure, the shear blocks 30 extend out be and an external surface of the post 20 while within the rail 40.

A gate or fence panel according to selected embodiments may be constructed quickly and easily. Shear blocks are secured to each end of each rail. In a particular embodiment, each shear block is slid into the end of a rail, and secured in that position by one or more fasteners. These fasteners may be screws, nails, rivets, anchors, or other means well known in the art. The shape of the shear block should be such that it mates with the shape of the rail. For example, if the rail includes an internal tongue along its length, the shear block should include an external groove that mates with said tongue. Such a mating pair helps guide and place the shear block within the rail as well as provide additional contact surfaces for the transfer of forces between the rail and the shear block. Having the shear block and rail initially as two separate pieces allows for the shear block to be made of a different material than the rest of the rail. This is especially beneficial when design considerations require different strength materials to be used for the rail compared to the shear block.

As discussed above, screws may be used to secure the shear block and rail together. However, leaving unfinished screws visible on the side of the rail may not be desirable. Therefore, a single sided snap cover (detachable fastener cover) to cover these fasteners and conceal them from view may be used, such as the one provided for in U.S. Pat. Pub. No. 20100252793 to Ash, the entirety of which is incorporated by reference. The pivot knuckle design on the detachable fastener cover has dual plane snap ribs that move the snapping action to the bottom of the rail, thus freeing up an upper chamber to allow for securely snapping on this cover. The freeing up of the upper chamber allows for the placement of a picket fastener just under the rail web, which allows for maximum rackability. The knuckle provides for a drip edge for proper water shed, which prohibits water from wicking back into the inside of the rail.

In an alternative embodiment, the shear block may be welded to the rail. In such a scenario, the rail and shear block can be manufactured at a central location, and then shipped to the onsite location with the posts unassembled. This is possible since the addition of the shear blocks to the rail does not significantly increase the external dimensions of the rail, if at all. For example, the two shear blocks are welded to rail, with one at each end. This is step is repeated for one or more rails. The rails with welded shear blocks are then placed into a box with two posts and fasteners to secure the shear blocks to the posts. This box is then shipped to the construction location via a package delivery company, such as United Parcel Service (UPS). Once the box with the parts arrives, the parts are removed and the panel is assembled. The rails are inserted into openings into the posts, and the fasteners are used to secure the shear blocks to the posts. In this manner, a fence or gate panel is inexpensively manufactured and shipped to a construction location where final assembly occurs.

In yet another alternative embodiment, the shear block and rail are extruded or cast as a single continuous piece. This reduces the labor and materials involved in securing the shear block to the rail, but may be more expensive to manufacture and/or may require additional material. Furthermore, it requires that the shear block be the same material as the rest of the rail, which in some designs may be undesirable and/or inefficient.

After the shear block is secured within the rail, the rail (with the shear block) is inserted through an opening in the post. The opening should match the dimensions of the rail, such that the rail with shear block secured thereto will fit through the opening with little to no noticeable gab between the rail and post after the rail is inserted through the opening. The shear block is then secure to the post by means of one or more fasteners, through preferably at least two fasteners. These fasteners can be screws, expansion anchors, or the like. In a particular embodiment, holes are created on the opposite side of the post from the opening. Openings in the shear block mate with the holes in the post, whereby expansion anchors are inserted through a hole and into the opening of the shear block. The expansion anchor is then expanded securing the shear block to the post.

In a particular embodiment of the current disclosure, the rail, post, and shear block are each manufactured from aluminum. Nonetheless, other materials may be used as well, such as iron, steel, and plastics. Furthermore, different materials may be used for the different components. The shear block may be a different material than the rail. For example, the shear block may be made from stainless steel, while the rail itself is made from aluminum. Similarly, the fasteners, post cap, and post may be made from the same or different materials than the shear block and/or rail.

When constructing the panel, each end of the rail should have a shear block secured thereto such that each end of the rail is secured to a post. To reduce design and manufacturing costs, it is preferable that the same shear block may be used for either end of the rail. Thus, each end of the shear block should include openings that mate with the holes in the post where fasteners are inserted therethrough.

Each end of each rail is secured to a post according to the method above to form a panel. If the panel is being used as a gate, then hinges are affixed to one of the posts, such that the gate may be secured to another structure.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

I claim:

1. A rail and post assembly comprising a post, a rail, a shear block, and a fastener, where the post comprises an opening, where the opening has a size and shape that is sufficient to allow the rail to extend therethrough, where the shear block mates with and is secured to the rail, where a portion of the shear block extends through the opening in the post and beyond an external surface of the post while within the rail, where the shear block comprises a groove along its length, wherein the rail comprises an internal tongue along its length, where the external groove of the shear block mates with the internal tongue of the rail, where the shear block abuts and is secured to the post on an opposing side from that of the opening of the post, where the fastener extends through the opposing side of the post to secure the shear block to the post.

2. The rail and post assembly of claim 1, wherein the fastener comprises a screw.

3. The rail and post assembly of claim 1, further comprising a second fastener, where the second fastener secures the shear block to the rail.

4. The rail and post assembly of claim 3, wherein the second fastener comprises a screw.

5. The rail and post assembly of claim 1, wherein the rail is a three-sided channel.

6. The rail and post assembly of claim 1, wherein the shear block is secured to the rail by one or more screws.

7. A gate panel comprising two posts, a rail, two shear blocks, and four fasteners, where one of the two shear blocks is secured to one end of the rail, where the other of the two shear blocks is secured to the other end of the rail, where each post comprises an opening, where each end of the rail passes through the opening of each post, where a portion of each shear block extends through the opening and beyond an external surface of the post to which the shear block is secured while within the rail and when assembled, where each shear block abuts and is secured to its respective post on an opposing side from that of the opening, where each fastener extends through the opposing side of the post to secure the shear block to the post;

where each shear block comprises a groove along its length, where the rail comprises an internal tongue along its length, where the external groove of the shear block mates with the internal tongue of the rail.

8. The gate panel of claim 7, wherein each shear block is secured to the rail by one or more screws.

9. The gate panel of claim 7, wherein each shear block is welded to the rail.

10. The gate panel of claim 7, wherein the fasteners are screws.

11. The gate panel of claim 7, wherein each post further comprises two holes, where the fasteners pass through the holes to secure the shear blocks to the posts.

12. The gate panel of claim 7, wherein each shear block comprises two openings, where the fasteners mate with the openings to secure the shear blocks to the posts, where two fasteners are used to secure each shear block to one of the two posts.

13. The gate panel of claim 7, further comprising a second rail, two additional shear blocks, and four additional fasteners, wherein each post further comprises an additional opening, where one of the two additional shear blocks is secured to one end of the second rail, where the other of the two additional shear blocks is secured to the other end of the second rail, where each end of the second rail passes through the additional opening in each post, where the additional fasteners secure the additional shear blocks to the posts thereby securing the second rail to each post.

14. A rail and post assembly comprising a post, a rail, a shear block, and a fastener, where the post comprises an opening, where the size and shape of the opening is sufficient to allow the rail to extend therethrough, where the shear block and rail together comprise a mating tongue and groove pair, where the shear block mates with and is fixed in place within the rail, where a portion of the shear block extends through the opening of the post while within the rail, where the shear block is secured to the post on an opposing side from that of the opening of the post, where the fastener extends through the opposing side of the post to secure the shear block to the post.

15. The rail and post assembly of claim 14, wherein the shear block is secured to the rail by one or more screws.

16. The rail and post assembly of claim 14, wherein the rail is a three-sided channel.

17. The rail and post assembly of claim 14, where the shear block is adjacent to the opposing side of the post.

18. The rail and post assembly of claim 14, where the shear block abuts against an inner surface of the opposing side of the post.

* * * * *